United States Patent [19]

Schaffer

[11] 4,072,104

[45] Feb. 7, 1978

[54] PRINTING UNIT DRIVE SYSTEM

[75] Inventor: Robert H. Schaffer, Mystic, Conn.

[73] Assignee: Harris-Intertype Corporation, Cleveland, Ohio

[21] Appl. No.: 628,056

[22] Filed: Nov. 3, 1975

Related U.S. Application Data

[63] Continuation of Ser. No. 384,403, Aug. 1, 1973, abandoned.

[51] Int. Cl.[2] ..... B41F 13/12

[52] U.S. Cl. ..... 101/248; 101/247

[58] Field of Search ..... 101/247, 248, 216, 219, 101/220

[56] References Cited

U.S. PATENT DOCUMENTS

| | | | |
|---|---|---|---|
| 3,073,997 | 1/1963 | Tabliasacchi | 101/248 X |
| 3,196,788 | 7/1965 | Knowles | 101/216 X |
| 3,447,456 | 6/1969 | Givizza | 101/248 X |
| 3,487,722 | 1/1970 | Cline | 74/640 X |
| 3,559,568 | 2/1971 | Stanley | 101/248 X |
| 3,565,006 | 2/1971 | Stewart | 101/248 |
| 3,701,464 | 10/1972 | Crum | 101/248 X |
| 3,724,368 | 4/1973 | Treff | 101/247 X |

OTHER PUBLICATIONS

Use Harmonic Drives, Feb. 1967, issue of Power Transmission Design.

"Mechanism and Dynamics of Machinery", 2nd Ed., Mabie and Ocvirk, 1963, Text ed., Chapt. 5.

"Design of Machine Elements", 4th Ed., Virgil M. Faires, c. 1965.

"Gears", Houghton, published 1952.

*Primary Examiner*—Robert Peshock

*Assistant Examiner*—Paul J. Hirsch

[57] ABSTRACT

An improved drive system for driving one unit of a printing press includes first and second meshing gears which are fixedly connected with blanket cylinders of the printing unit. Third and fourth gears are driven by the associated blanket cylinder gears and are connected with the plate cylinders of the printing unit through harmonic drive units. To tend to minimize backlash and enable the blanket cylinders to be thrown off while maintaining the gears in meshing engagement, the plate and blanket cylinder gears have design pitch circles which intersect. The harmonic drive units have internal gears which, during operation of the printing press, are effective to rotate the plate cylinders relative to the plate cylinder gears. To enable the plate and blanket cylinders to be driven at the same surface speed, it is necessary to offset or compensate for the effect of the gears in the harmonic drive units. In one embodiment of the invention, the effect of the gears in the harmonic drive units is compensated for by providing the blanket cylinder gears with fewer teeth than are necessary to drive the plate cylinders at the same surface speed as the blanket cylinders. However, the blanket cylinder gears have a larger design pitch diameter than standard gears of the same pitch to enable their design pitch circles to intersect the design pitch circles of the plate cylinder gears. In another embodiment of the invention, the number of teeth on the blanket cylinder gears is sufficient to rotate the plate cylinders at the same surface speed as the blanket cylinders and the gears have standard pitch diameters. In this embodiment of the invention, motors in the harmonic drive units are operated to drive the harmonic drive units in a manner to offset or compensate for the effect of the gears in the harmonic drive units.

5 Claims, 6 Drawing Figures

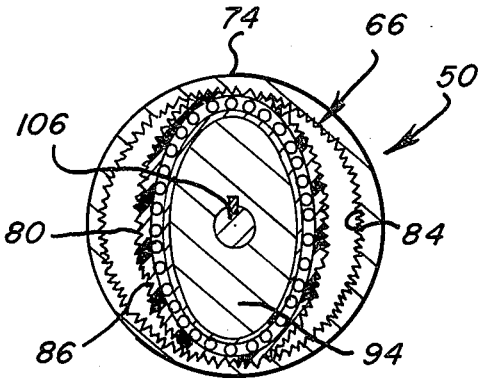
FIG. 4
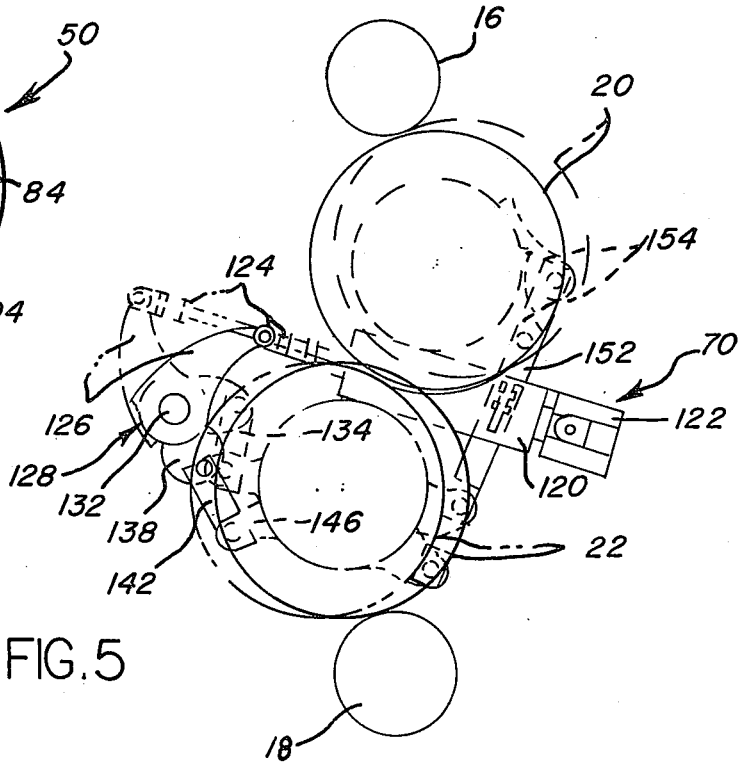
FIG. 5
FIG. 6
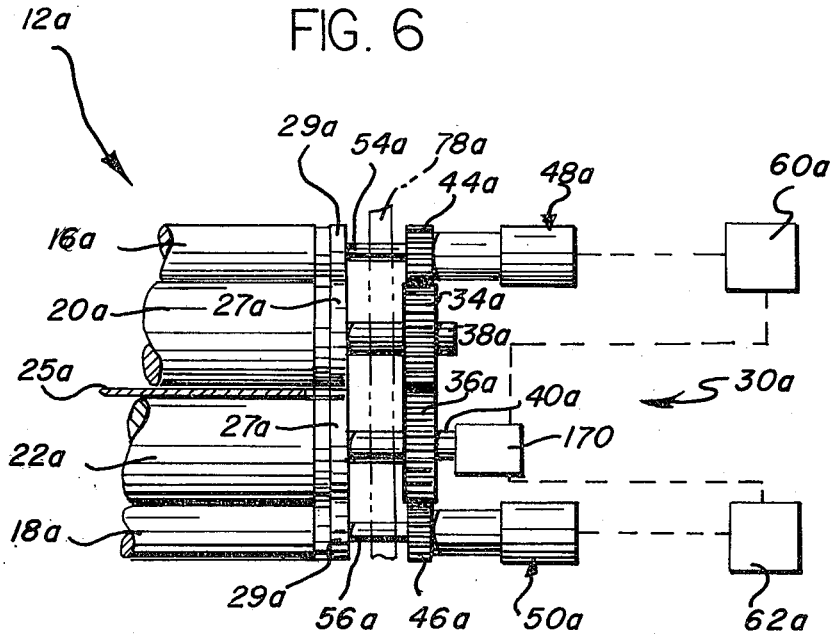

PRINTING UNIT DRIVE SYSTEM

This is a continuation of application Ser. No. 384,403, filed Aug. 1, 1973, now abandoned.

BACKGROUND OF THE INVENTION

The present invention relates to an improved drive arrangement for a unit of a printing press.

A known printing press drive arrangement is disclosed in U.S. Pat. No. 3,724,368 and includes two gears connected to each blanket cylinder. One set of blanket cylinder gears drive the blanket cylinders. Another set of blanket cylinder gears drive the plate cylinders through a drive train which includes plate cylinder gears and harmonic drive units. The harmonic drive units contain flexible splines having external gear teeth which cooperate with internal gear teeth to rotate the plate cylinders relative to the plate cylinder gears. To compensate for the effect of the gears in the harmonic drive units, the number of teeth on the set of blanket cylinder gears which drive the plate cylinder gears is less than the number required to rotate the plate cylinders at the same surface speed as the blanket cylinders. This enables the output from the harmonic drive units to rotate the plate cylinders at a surface speed which is equal to the surface speed of the blanket cylinders.

To compensate for the action of the gearing in the harmonic drive units, the set of blanket cylinder gears which drive the plate cylinder gears in the known drive arrangement have 119 teeth. The plate cylinder gears have 60 teeth. Since the blanket cylinder has a diameter which is twice as great as the diameter of the plate cylinder, the blanket cylinder gears would normally have twice as many teeth as the plate cylinder gears, that is 120 teeth. By providing the blanket cylinder gears which drive the plate cylinder gears with a relatively small number of teeth, the output from the gearing in the harmonic drive unit results in the plate cylinder being driven at the same surface speed as the blanket cylinder.

When standard gears having a relatively small number of teeth are substituted for standard gears having a larger number of teeth and the same pitch, the substituted gears will have pitch diameters which are smaller than normal for the distance between the centers about which the gears rotate. Thus in the known drive system, the 119 tooth blanket gears which drive the plate cylinder gears have a pitch diameter which is less than the pitch diameter of a 120 tooth blanket cylinder gear of the same pitch.

The relatively small pitch diameter of the standard blanket cylinder gears utilized to drive the plate cylinder gears in the known drive system results in a relatively large amount of backlash between the plate and blanket cylinder gears and adversely effects the driving relationship between the gears. In addition to adversely effecting the driving relationship between the gears when the known printing press is being utilized for printing operations, the relatively small pitch diameters of the standard blanket cylinder gears results in a relatively small overlap between the teeth of the blanket cylinder gears when the blanket cylinders are thrown off. Therefore, the blanket cylinder gears may not reliably carry the drive forces for driving the blanket cylinder gears when thrown off. To compensate for this, the known printing press drive arrangement disclosed in U.S. Pat. No. 3,724,368 utilizes two gears in association with each blanket cylinder. Of course, the necessity of providing two gears with each blanket cylinder increases the cost of constructing the printing press.

SUMMARY OF THE PRESENT INVENTION

The present invention provides a new and improved printing press drive arrangement which includes plate and blanket cylinder gears which are disposed in meshing driving engagement. The blanket cylinder gear is connected directly to the blanket cylinder. However, the plate cylinder gear is connected with the plate cylinder through a drive unit which can be activated to adjust registration between the plate and blanket cylinders. To prevent excessive backlash between the plate and blanket cylinder gears, they have pitch circles which intersect.

The plate and blanket cylinders are rotated at the same surface speed. However, the drive unit has internal gearing which rotates the plate cylinder relative to the plate cylinder gear. To compensate for the effect of the gearing in the drive unit, in one embodiment of the invention the blanket cylinder gear has fewer teeth than is necessary to drive the plate cylinder at the same speed as the blanket cylinder. To enable the pitch circle of this blanket cylinder gear to intersect the pitch circle of the plate cylinder gear, the blanket cylinder gear is formed with a pitch diameter which is greater than the pitch diameter of a standard gear, that is the pitch diameter of the blanket cylinder gear is greater than the number of teeth on the gear divided by the diametral pitch of the gear.

In a second embodiment of the invention, plate and blanket cylinder gears have standard pitch diameters. Therefore the pitch circles of these gears intersect at the points of tangency of the pitch circles. The effect of the gearing in the drive unit is compensated for by activating a motor to provide an offsetting input to the differential drive unit.

Accordingly, it is the object of this invention to provide a new and improved printing press having a drive arrangement which includes a drive unit connected with one printing cylinder to adjust registration, a first gear connected with another printing cylinder, a second gear disposed in meshing engagement with the first gear and providing the input to drive unit, and wherein the pitch circles of the first and second gears intersect and the gears cooperate with each other and the drive unit to rotate the printing cylinders at the same surface speed during operation of the printing press.

Another object of this invention is to provide a new and improved printing press drive arrangement having a blanket cylinder gear which is disposed in meshing engagement with a plate cylinder gear which drives a harmonic drive unit to rotate the plate cylinder at the same surface speed as the blanket cylinder, the effect of internal gearing within the harmonic drive unit being compensated for by the blanket cylinder gear which has a number of teeth which is less than the number of teeth required to rotate the plate cylinder at the same surface speed as the blanket cylinder, and wherein the blanket cylinder gear has a pitch diameter which is greater than the pitch diameter of a standard gear having the same pitch and number of teeth.

Another object of this invention is to provide a new and improved printing press drive arrangement which includes a harmonic drive unit connected with a plate cylinder, a blanket cylinder gear having a standard pitch diameter, and a plate cylinder gear having a standard pitch diameter and forming the input to the harmonic drive unit and wherein the effect of gearing within the harmonic drive unit is offset by operating a motor to provide an input to the harmonic drive unit which varies as a function of variations in operating speed of the printing press.

BRIEF DESCRIPTION OF THE DRAWINGS

The foregoing and other objects and features of the present invention will become more apparent upon a consideration of the following description taken in connection with the accompanying drawings wherein;

FIG. 4 is a sectional view, taken generally along the line 4—4 of FIG. 3, illustrating the construction of internal gearing in the harmonic drive unit;

FIG. 5 is a schematic illustration of a throwoff mechanism for moving blanket cylinders apart from an active printing position to an inactive or thrownoff position; and FIG. 6 is a schematic illustration of a second embodiment of the invention.

DESCRIPTION OF SPECIFIC PREFERRED EMBODIMENTS OF THE INVENTION

Figure 1:
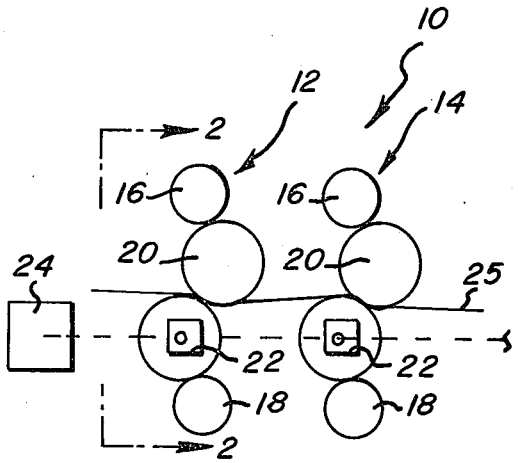
FIG. 1 is a schematic illustration of a printing press having a plurality of printing units with drive systems constructed in accordance with the present invention.

A multi-color perfecting press 10 constructed in accordance with the present invention is illustrated schematically in FIG. 1. The press 10 includes a pair of printing units 12 and 14 having plate cylinders 16 and 18 and blanket cylinders 20 and 22. The blanket cylinders 22 are driven from a main press drive train 24 to effect operation of the printing units 12 and 14 to print on opposite sides of a web 25 in a known manner. During operation of the printing press 10, annular outer surfaces 26 (FIG. 2) on circular blanket cylinder bearers 27 are disposed in rolling engagement with each other and with annular outer surfaces 28 of circular plate cylinder bearers 29.

The printing unit 12 includes an improved drive system 30 (FIG. 2) which drives the plate and blanket cylinders 16, 18, 20 and 22 at the same surface speed and enables the circumferential registration of the printing unit 12 to be adjusted. The drive system 30 includes a pair of blanket cylinder gears 34 and 36 which are fixedly connected with drive shafts 38 and 40 for the blanket cylinders 20 and 22. The blanket cylinder gears 34 and 36 are of identical construction and rotate the blanket cylinders 20 and 22 at the same surface speed under the influence of drive forces from the main drive train 24.

Figure 2:
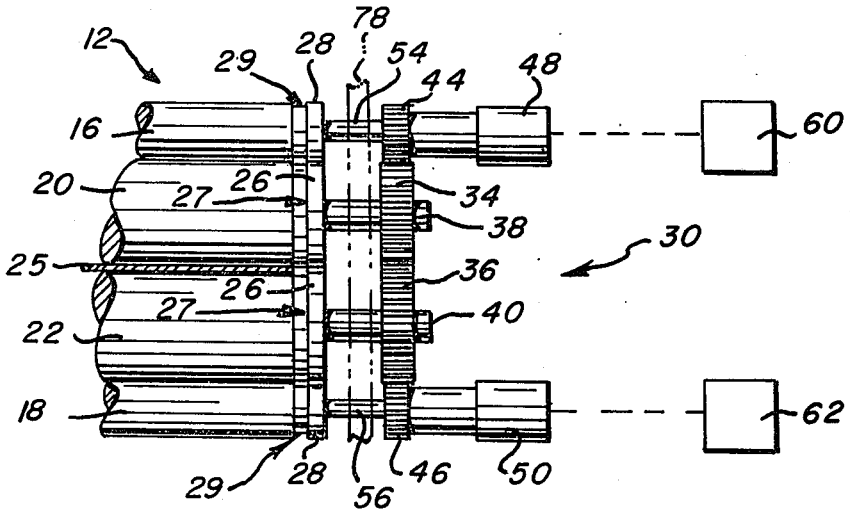
FIG. 2 is a fragmentary view, taken generally along the line 2—2 of FIG. 1, illustrating the relationship between plate and blanket cylinder drive gears and a pair of harmonic drive units in the drive system for printing unit of the printing press of FIG. 1.

The drive system 30 includes a pair of identical plate cylinder gears 44 and 46 which are drivingly connected with the plate cylinders 16 and 18 through harmonic drive units 48 and 50 (FIG. 2). The plate cylinder gears 44 and 46 are disposed in meshing engagement with the blanket cylinder gears 34 and 36 and are driven by the blanket cylinder gears to provide the input for the harmonic drive units 48 and 50. The harmonic drive units 48 and 50 drive shafts 54 and 56 which are fixedly connected with the plate cylinders 16 and 18 to rotate the plate cylinders at the same surface speed as the blanket cylinders 20 and 22. When the circumferential registration of the printing unit 12 is to be adjusted, suitable controls 60 and 62 are actuated to activate the harmonic drive units 48 and 50 in a known manner.

The harmonic drive unit 50 includes an internal differential gearing arrangement 66 (see FIGS. 3 and 4) which functions to drive the plate cylinder shaft 56 relative to the plate cylinder gear 46 upon rotation of the blanket cylinder gear 36. If the blanket and plate cylinder gears 36 and 46 have a gear ratio which is equal to the ratio of the diameters of the blanket cylinder bearers 27 to the diameter of the plate cylinder bearers 29, the output from the internal gearing 66 of the harmonic drive unit 50 would drive the plate cylinder 18 at a surface speed which is greater than the surface speed of the blanket cylinder 22. Thus, if the ratio of the diameter of the bearer 27 of the blanket cylinder 22 to the diameter of the bearer 29 of the plate cylinder 18 was 2 to 1 and the gear ratio between the blanket gear 36 and plate gear 46 was also 2 to 1, the output from the gearing 66 in the harmonic unit 50 would effect rotation of the plate cylinder, 18 at a surface speed which is greater than the surface speed at which the blanket 22 is rotated. Of course, the blanket and plate cylinders 22 and 18 must be rotated at the same surface speed to obtain quality printing.

In order to effect rotation of the blanket and plate cylinders 22 and 18 at the same surface speed, the blanket gear 36 is provided with a number of teeth which is smaller than the number of teeth necessary to drive the plate cylinder 18 at the same speed as the blanket cylinder. Thus, the ratio of the diameter of the bearer 27 of the blanket cylinder 22 to the diameter of the bearer 29 of the plate cylinder 18 is 2 to 1 and the blanket cylinder gear 36 has slightly less than twice as many teeth as the plate cylinder gear 46. Although different teeth number combinations could be utilized, in the illustrated embodiment of the invention the blanket cylinder gear 36 has 107 teeth while the plate cylinder gear 46 has 54 teeth.

Since the blanket cylinder gear 36 is provided with a number of teeth which is less than the number of teeth required to have the gear ratio between the blanket cylinder gear 36 and the plate cylinder gear 46 equal the ratio between the diameters of the bearers 27 and 29 of the blanket cylinder 22 and the plate cylinder 18, the gearing 66 in the harmonic drive unit 50 is utilized to compensate for the difference between the gear and diameter ratios. Thus, the blanket cylinder gear 36 is effective to drive the plate cylinder gear 46 at a speed which is slightly less than the speed at which the plate cylinder 18 must be driven. However, the plate cylinder gear 46 drives the plate cylinder 18 through the harmonic drive unit 50. The internal gearing 66 is effective to increase the input speed from the plate cylinder gear 46 to drive the plate cylinder 18 at the same surface speed as the blanket cylinder 22.

To provide smooth meshing engagement with a relatively small amount of backlash, the pitch circle of the blanket cylinder gear 46 should intersect the design pitch circle of the plate cylinder gear. For a given pitch, the diameter of the pitch circle of a standard gear is determined design by the number of teeth on the gear.

Since the blanket cylinder gear 36 has 107 teeth while the plate cylinder gear has 54 teeth, an eight pitch standard blanket gear 36 would have a design pitch diameter of 13.375 inches and a standard plate cylinder gear 46 would have a design pitch diameter of 6.75 inches. However, in order to provide the blanket cylinders 16 and 18 with the necessary printing circumference, the blanket cylinder bearers 27 each have a diameter of approximately 13.53 inches while the plate cylinder bearers 29 have a diameter of approximately 6.765 inches. Since the sum of the design pitch diameters of standard eight pitch gears having 54 and 107 teeth is less than the sum of the diameters of the plate cylinder bearer 29 and a blanket cylinder bearer 27, the design pitch circles of the standard gears would be spaced apart. With this mounting arrangement in which the centers of the standard gears would be further apart than the sum of their design pitch circle radii, the tangent working pitch circles would have diameters which are greater than the diameters of their design pitch circles.

The spacing between the pitch circles of the standard eight pitch blanket and plate cylinder gears would result in backlash between the gears. In addition to promoting backlash, the extent to which the teeth of the standard eight pitch blanket cylinder gear 36 would mesh or overlap with the teeth of the standard eight pitch blanket cylinder gear 34 would be relatively small. Although meshing engagement or overlapping of the standard eight pitch gears may be sufficient to reliably transmit operating loads when the blanket cylinder gears 34 and 36 are running in normal meshing engagement, it is common practice to move the blanket cylinders 20 and 22 apart from each other and the plate cylinders 16 and 18 with a throwoff mechanism 70 (FIG. 5) for makeready purposes. During makeready, it is necessary for the blanket gears 34 and 36 and plate cylinder gears 44 and 46 to be utilized to jog the cylinders 16, 18, 20 and 22 of the printing unit 12 to maintain the cylinders in registration with each other. If the standard blanket cylinder gears 34 and 36 having a relatively small pitch diameter are utilized, the meshing relationship may not be sufficient to reliably carry the drive forces.

In accordance with a feature of one embodiment of the present invention, nonstandard blanket cylinder gears 34 and 36 and plate cylinder gears 44 and 46 are utilized in the drive system 30. These nonstandard blanket and cylinder gears 34 and 36 and plate cylinder gears 44 and 46 have relatively large design pitch circle pitch diameters for the number of teeth on the gears. Thus, the design pitch diameter of the blanket cylinder gears 34 and 36 and the plate cylinder gears 44 and 46 is greater than the number of teeth on these gears divided by the diametral pitch of these gears. The blanket cylinder gears 34 and 36 have 107 teeth and the plate cylinder gears 44 and 46 have 54 teeth. The diametral design pitch of these gears is eight and their pitch diameters are approximately 6.81 and 13.53 inches respectively. Of course, the design pitch diameter of a standard gear having a diametral pitch of eight and design 107 teeth is 13.375 and the pitch diameter of a standard gear having a diametral pitch of eight and 54 teeth is 6.75 inches.

The pitch diameter of the blanket cylinder gear 36 is approximately the same (within normal tolerance ranges) as the diameter of the blanket cylinder bearer 27. However, the plate cylinder gear 46 has a design pitch diameter which is greater than the diameter of the plate cylinder bearer 29. Thus, the plate cylinder gear 46 has a design pitch diameter of approximately 6.81 inches while the plate cylinder bearer 29 has a diameter of approximately 6.765 inches. This results in two points of intersection between the design pitch circles for the plate and blanket cylinder gears 36 and 46 rather than the single point of intersection which is present with tangent pitch circles of standard gears. It should be understood that the working pitch circles of a pair of meshing gears are always, by definition, disposed in tangency with each other and have a single point of intersection. Therefore, the working pitch circle of the plate cylinder gear 46 has a diameter of approximately 6.765 inches and is smaller than the design pitch circle diameter.

By forming the blanket cylinder gears 34 and 36 and the plate cylinder gears 44 and 46 with larger than standard pitch diameters, there is a relatively small amount of backlash between these gears even though the blanket cylinder gears 34 and 36 have a relatively small number of teeth. In addition, the relatively large design pitch diameters of the blanket cylinder gears 34 and 36 and plate cylinder gears 44 and 46 provide a relatively large amount of meshing engagement between these gears. Therefore, when these blanket cylinders 20 and 22 are thrown off, the gears will reliably transmit operating loads incurred during jogging of the printing unit 12.

The internal gearing 66 in the harmonic drive unit 50 is such that even though the plate cylinder gear 46 is rotated at a speed which is less than that required to rotate the plate cylinder 18 at the surface speed of the blanket cylinder 22, the input from the internal gearing 66 in the harmonic drive unit 50 rotates the plate cylinder 18 at a surface speed equal to the surface speed of the blanket cylinder 22. The harmonic drive unit 50 has a known construction that includes a cylindrical input member 74 (see FIG. 3) which is integrally formed with the plate cylinder gear 46. The input member 74 is supported for rotation relative to the plate cylinder shaft 56 and a frame 78 of the printing press 10 on suitable bearings 80. An internal gear 84 (FIG. 4) of the differential gearing arrangement 66 is formed on the inside of the input member 74. A flexible output member 86 has external gear teeth 88 which are disposed in meshing engagement with the internal gear teeth 84. The flexible output member 86 is connected with the plate cylinder shaft 56 (see FIG. 3) by suitable fasteners 90.

As the input member 74 to the harmonic drive unit 50 is rotated by the plate cylinder gear 46, the internal teeth 84 cooperate with the external teeth 88 on the output member 86 to rotate the output member at a speed which is slightly greater than the speed of rotation of the input member 74. Thus, the array of teeth 88 on the output member 86 has a smaller circumferential extent than the annular array of internal teeth 84 on the input member 74. As the input member 74 is rotated by the plate cylinder gear 46, the flexible output member 86 is rotated about a stationary wave generator member 94. The wave generator member 94 deforms the flexible output member 86 so that some of the teeth 88 are in meshing engagement at all times with some of the teeth 84 on the input member 74. The ratio between the number of internal teeth 84 on the input member 74 and the number of external teeth 88 on the output member 86 is such as to rotate the output member 86 to drive the plate cylinder 18 at the same peripheral speed as the blanket cylinder 22 even though the blanket cylinder gear 36 has a relatively small number of teeth for the reasons previously explained. In the specific preferred embodiment of the invention which has been utilized as an example herein and in which the blanket cylinder gear 36 has 107 teeth which the plate cylinder gear 46 has 54 teeth, the harmonic drive unit 50 has 216 internal teeth 84 while the output 86 has 214 teeth 88.

When the rotational position of the plate cylinder 18 is to be adjusted relatively to the blanket cylinder 22, the controls 62 (FIG. 2) activate a stepping motor 100 to drive the wave form generator 94 through a coupling 104 and drive shaft 106 which is rotatably mounted on bearings 108. However, it should be noted that during normal operation of the printing press 10 the circumferential registration of the plate cylinder 18 is maintained constant so that the wave form generator 94 is stationary when the stepping motor 100 is in a de-energized condition.

Although the construction of only the harmonic drive unit 20 has been set forth herein, it should be understood that the harmonic drive unit 48 is of the same construction. Since the construction and mode of operation of the harmonic drive units 48 and 50 are generally similar to that disclosed in U.S. Pat. No. 3,724,368; it will not be further described herein. However, it should be understood that the specific number of internal gear teeth 84 and external gear teeth 88 set forth herein was merely for purposes of illustration and other suitable numbers of gear teeth could be utilized if desired. It should also be understood that the blanket cylinder gear 34 is identical to the blanket cylinder gear 36 and the plate cylinder gear 44 is identical to the plate cylinder gear 46. The specific number of gear teeth set forth in connection with blanket cylinder gears 34 and 36 and plate cylinder gears 44 and 46 could be varied along with the size of these gears and the bearers 27 and 29.

The throwoff mechanism 70 for moving the blanket cylinders 20 and 22 away from the plate cylinders 16 and 18 is of a known construction and includes an air cylinder 120 which is pivotally connected with a mounting bracket 122 secured to the frame 78 of the printing press 10. A piston rod 124 of the cylinder 120 is pivotally secured to an arm 126 of a crank member 128. The crank member 128 is pivotally mounted on a pin 132 secured to the press frame 78. A second arm 138 of the crank member 128 is pivotally connected with a link 142. The link 142 is also pivotally connected to an eccentric 146 which supports bearings associated with the blanket cylinder 22. When the crank member 126 is rotated by the piston 120, the eccentric 146 moves the blanket cylinder 22 to a throwoff position in which it is spaced apart from the blanket cylinder 20 and the plate cylinder 18.

The throwoff mechanism 70 also includes a connecting link 152 which is connected with an eccentric member 154. Since the link 152 moves the eccentric 154 when the eccentric 146 is moved, the blanket cylinder 20 is moved away from the blanket cylinder 22 and plate cylinder 16 simultaneously with movement of the blanket cylinder 22 away from the blanket cylinder 20 and plate cylinder 18. Although the thrownoff mechanism 70 has been described herein as having a specific known construction, it is contemplated that many different types of throwoff mechanisms could be utilized. For example, the throwoff mechanism 70 could be constructed in the manner disclosed in U.S. Pat. No. 3,527,165.

In the embodiment of the invention illustrated in FIGS. 1–5, the blanket cylinder gears 34 and 36 have a relatively small number of teeth so that the plate cylinder gears 44 and 46 were driven at a speed less than that required to rotate the blanket cylinders 16 and 18 at the same surface speed as the plate cylinders 20 and 22. In the embodiment of the invention illustrated in FIG. 6, the gear ratio between the blanket cylinder gears and the plate cylinder gears is such that the blanket cylinder gears are effective to rotate the plate cylinder gears at a speed sufficient to rotate the plate cylinders at the same surface speed as the blanket cylinders. In the embodiment of the invention illustrated in FIG. 6, the stepping motors in the harmonic drive units are activated to offset the input from the internal gearing in the harmonic drive units. Since the embodiment of the invention disclosed in FIG. 6 is generally similar to the embodiment of the invention disclosed in FIGS. 1–5, similar numerals will be utilized to designate similar components, the suffix letter "*a*" being added to the numerals associated with FIG. 6 to avoid confusion.

The printing unit **12*a* includes a pair of plate cylinders 16*a* and 18*a* and a pair of blanket cylinders 20*a* and 22*a* which are utilized to print on opposite sides of a web 25*a*. A pair of blanket cylinders 34*a* and 36*a* are fixedly connected with blanket cylinder drive shafts 38*a* and 40*a*. Plate cylinder gears 44*a* and 46*a* drive harmonic drive units 48*a* and 50*a*. The harmonic drive units 48*a* and 50*a* have outputs connected directly to the plate cylinder drive shafts 54*a* and 56*a***.

The plate cylinder gears **34*a* and 36*a* and the blanket cylinder gears 44*a* and 46*a* are of a standard construction. The gear ratio between the blanket cylinder gear 36*a* and the plate cylinder gear 46*a* is the same as the ratio of the diameters of the blanket cylinder 22*a* to the diameter of the plate cylinder 18*a*. Thus, the diameter of the blanket cylinder 22*a* is twice the diameter of the plate cylinder 18*a* and the blanket cylinder gear 36*a* has twice as many teeth as the plate cylinder gear 46*a*. Therefore, the blanket cylinder gears 34*a* and 36*a* are effective to drive the plate cylinder gears 44*a* and 46*a* at a speed sufficient to rotate the plate cylinders 16*a* and 18*a* at the same surface speed as the blanket cylinders 20*a* and 22*a***.

The plate and blanket cylinder gears **34*a*, 36*a*, 44*a* and 46*a* are standard gears having pitch circles which intersect at the points of tangency between the pitch circles. Thus, the blanket cylinder gears 34 and 36 have pitch diameters equal to the diameters of blanket cylinder bearers 27*a*. The plate cylinder gears have pitch diameters equal to the diameters of the plate cylinder bearers 29*a*. Since the bearers 27*a* and 29*a* are disposed in rolling engagement, the pitch circles for the blanket and plate cylinder gears are disposed in rolling engagement and intersect at their points of tangency. Although the standard eight pitch plate cylinder gears 34*a* and 36*a* have 108 teeth and the standard eight pitch blanket cylinder gears have 54** teeth, it is contemplated that other standard gear arrangements could be utilized.

Figure 3:
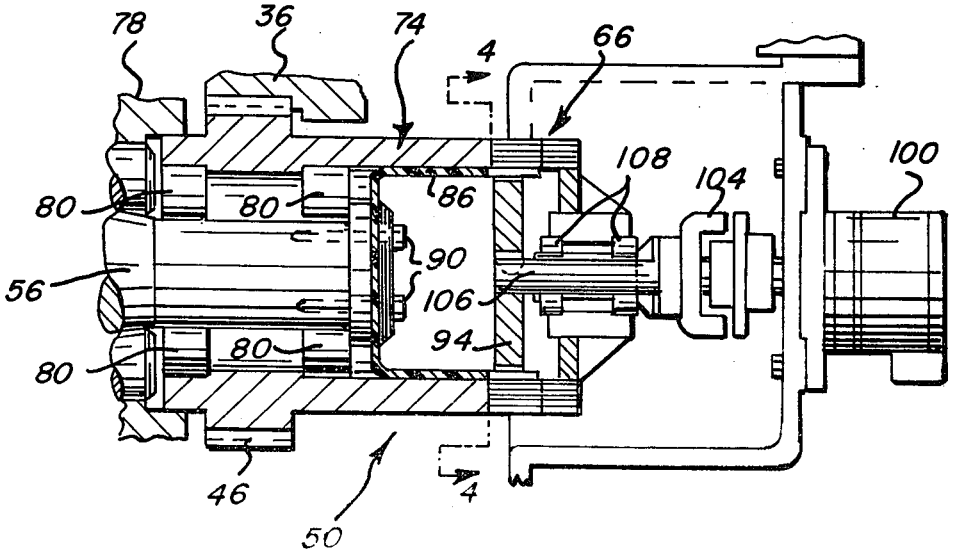
FIG. 3 is an enlarged sectional view, illustrating the construction of one of the harmonic drive units of FIG. 2.

The harmonic drive units **48*a* and 50*a* have the same construction as the harmonic drive unit 50 of FIG. 3. Therefore, gearing 66 in the harmonic units 48*a* and 50*a* tend to provide an output component which would drive the plate cylinders 16*a* and 18*a* at a higher speed than the speed at which the plate cylinder gears 44*a* and 46*a* are driven by the blanket cylinder gears 34*a* and 36*a*. To compensate for the interaction between the internal gears in the harmonic drive units 48*a* and 50*a*, the wave generators 94 in the harmonic drive units 48*a* and 50*a* are continuously rotated by motors 100 at a speed which varies as a function of variations in the speed at which the printing unit 12***a* is operated in order to maintain registration during operation of the printing unit. Thus, the wave generators 94 in the harmonic drive units 48*a* and 50*a* are continuously rotated in a direction to offset or counteract the rotational input of the gearing in the harmonic drive units 48*a* and 50*a* due to the difference in the number of internal teeth provided on the input member 74 to the harmonic drive units and the number of external teeth provided on the output members 86.

In order to continuously rotate the wave form generator members 94 in the harmonic drive units 48*a* and 50*a* at a speed which varies as a function of variations in the operating speed in the printing unit 12*a*, a sensor assembly 170 (FIG. 6) is connected with the drive shaft 40*a* for the blanket cylinder 22*a*. Although many different known types of sensor assemblies could be utilized, the sensor assembly 170 is of the type which includes a perforated disc which is driven past a photocell at a speed proportional to the speed at which the blanket cylinder 22 is driven to generate a series of pulses. The pulses from the sensor assembly 170 are conducted to the control assembly 60*a* for the harmonic drive unit 48*a* and to the control assembly 62*a* for the harmonic drive unit 50*a*. The control units 60*a* and 62*a* effect energization of the stepping motors 100 for the harmonic drive units 48*a* and 50*a* to drive the wave form generator members 94 at a speed sufficient to cause the output members 86 of the harmonic drive units 48*a* and 50*a* to drive the plate cylinder drive shafts 54*a* and 56*a* at the same rotational speed at which the plate cylinder gears 44*a* and 46*a* are driven by the blanket cylinder gears 34*a* and 36*a*. It should be noted that the speed at which the stepping motors, similar to stepping motor 100 of FIG. 3, in the harmonic drive units 48*a* and 50*a* are driven varies as a direct function of variations in the rotational speed of the blanket gears 34*a* and 36*a*.

From the foregoing description it is apparent that the printing press drive system 30 includes plate and blanket cylinder gears 34, 36, 44 and 46 which are disposed in driving meshing engagement. The blanket cylinder gear 36 is connected directly to the blanket cylinder 22. However, the plate cylinder gear 46 is connected with the plate cylinder 18 through a drive unit 50 which can be activated by controls 62 to adjust registration between the plate and blanket cylinders 18 and 22. To prevent excessive backlash between the plate and blanket cylinder gears, they have pitch circles which intersect. In the embodiment of the invention illustrated in FIG. 2, the pitch circles of the blanket and plate cylinder gears 36 and 46 overlap and intersect at two points. In the embodiment of this invention illustrated in FIG. 6, the pitch circles of the blanket and plate cylinder gears 36*a* and 46*a* are tangent and intersect at one point. The plate and blanket cylinders 16, 18, 20 and 22 are rotated at the same surface speed. However, the drive units 48 and 50 have internal gearing 66 which rotates the plate cylinders 16 and 18 relative to the plate cylinder gears 44 and 46. To compensate for the effect of the gearing 66 in the drive units 48 and 50 in the embodiment of the invention illustrated in FIG. 2, the blanket cylinder gears 34 and 36 have fewer teeth than is necessary to drive the plate cylinders 16 and 18 at the same surface speed as the blanket cylinders 20 and 22. To enable the pitch circles of the blanket cylinder gears 34 and 36 to intersect the pitch circles of the plate cylinder gears 44 and 46, the blanket cylinder gears are formed with pitch diameters which are greater than the pitch diameter of a standard gear, that is the pitch diameters of the blanket cylinder gears are greater than the number of teeth on the gears divided by the diametral pitch of the gears.

In the embodiment of the invention illustrated in FIG. 6, plate and blanket cylinder gears 34*a*, 36*a*, 44*a* and 46*a* have standard pitch diameters. Therefore, the pitch circles of these gears intersect at the points of tangency of the pitch circles. The effect of the gearing 66 in the drive units 48*a* and 50*a* is compensated for by activating motors 100 to provide an offsetting input to the drive units. To enable the offsetting inputs to the drive units 48*a* and 50*a* to vary as a function of variations in printing press speed, a sensor assembly 170 detects variations in the opeating speed of the printing press and activates controls 60*a* and 62*a* to vary the outpu speed of the motors with variations in press speed.

Having described specific preferred embodiments of the invention, the following is claimed:

1. A printing press comprising, first and second blanket cylinders defining a printing nip and having a first position in which said blanket cylinders are cooperable to print on opposite sides of sheet material advanced through the nip and a second position in which said blanket cylinders are ineffective to print on the sheet material, a first bearer fixedly connected with said first blanket cylinder and having a circular outer surface, a second bearer fixedly connected with said second blanket cylinder and having a circular outer surface of the same diameter as the diameter of the circular outer surface of said first bearer, said outer surfaces of said first and second bearers being disposed in rolling engagement when said blanket cylinders are in said first position, said first and second bearers forming a set of blanket cylinder bearers, first and second plate cylinders which engage said blanket cylinders when the blanket cylinders are in the first position, each of said plate cylinders being spaced apart from and ineffective to transfer an image to the associated blanket cylinder when the blanket cylinders are in the second position, a third bearer fixedly connected with said first plate cylinder and having a circular outer surface disposed in rolling engagement with the circular outer surface of said first bearer when said blanket cylinders are in said first position, a fourth bearer fixedly connected with said second plate cylinder and having a circular outer surface disposed in rolling engagement with the circular outer surface of said second bearer when said blanket cylinders are in said first position, said third and fourth bearers having circular outer surfaces of the same diameter and forming a set of plate cylinder bearers, throw-off means for effecting relative movement between said first and second blanket cylinders from the first position to the second position in which said blanket cylinders are ineffective to print on sheet material and are spaced apart from said plate cylinders, said throw-off means being effective to relatively move said blanket cylinders from the second position to the first position in which said blanket cylinders are effective to print on sheet material and are in engagement with said plate cylinders, means for drivingly interconnecting said first and second blanket cylinders when in their first and second positions, said means for drivingly interconnecting said first and second blanket cylinders comprising, first and second gears having equal numbers of teeth and having design pitch circles of the same diameters as said first and second bearers, said first and second gears being different from standard gears in that said first and second gears each have a design pitch diameter which is greater than the number of teeth on the gear divided by the diametral pitch of the gear, means for connecting said first gear to said first blanket cylinder in a coaxial relationship with said first bearer, and means for connecting said second gear to said second blanket cylinder in a coaxial relationship with said second bearer, said first and second gears having gear teeth which are disposed in meshing engagement when said blanket cylinders are in their first and second positions, said design pitch circles of said first and second gears having a single point of intersection when said blanket cylinders are in said first position, said first and second gears forming a set of blanket cylinder gears which is associated with said set of blanket cylinder bearers, a third gear having gear teeth disposed in meshing engagement with gear teeth of said first gear when said first and second blanket cylinders are in their first and second positions, a fourth gear having gear teeth disposed in meshing engagement with gear teeth of said second gear when said first and second blanket cylinders are in their first and second positions, means drivingly connecting said third gear with said first plate cylinder in a coaxial relationship with said third bearer, said third gear having a design pitch circle of a diameter which is greater than the diameter of said third bearer, said design pitch circle of said third gear overlapping and having two points of intersection with the design pitch circle of said first gear when said blanket cylinders are in said first position, said third gear having a working pitch circle which is of a smaller diameter than its design pitch circle, the working pitch circle of said third gear being tangent to the working pitch circle of said first gear when said blanket cylinders are in said first position, the number of gear teeth on said first gear meshing with the gear teeth of said third gear being less than that required to rotate the surface of said first plate cylinder at the surface speed of said first blanket cylinder, said means drivingly connecting said third gear with said first plate cylinder including means for effecting rotation of said first plate cylinder relative to said third gear to effect rotation of the surface of said first plate cylinder at the surface speed of said first blanket cylinder, means drivingly connecting said fourth gear with said second plate cylinder in a coaxial relationship with said fourth bearer, said fourth gear having a design pitch circle of a diameter which is greater than the diameter of said fourth bearer, said design pitch circle of said fourth gear overlapping and having two points of intersection with the design pitch circle of said second gear when said blanket cylinders are in said first position, said fourth gear having a working pitch circle which is of a smaller diameter than its design pitch circle, the working pitch circle of said fourth gear being tangent to the working pitch circle of said second gear when said blanket cylinders are in said first position, the number of gear teeth on said second gear meshing with gear teeth of said fourth gear being less than required to rotate the surface of said second plate cylinder at the surface speed of said second blanket cylinder, said third and fourth gears each being different from standard gears in that said third and fourth gears each have a design pitch diameter which is greater than the number of teeth on the gear divided by the diametrical pitch of the gear, said third and fourth gears forming a set of plate cylindrical gears which is associated with said set of plate cylinder bearers, said means for drivingly connecting said fourth gear with said second plate cylinder including means for effecting rotation of said second plate cylinder relative to said fourth gear to effect rotation of the surface of said second plate cylinder at the surface speed of said second blanket cylinder.

2. A printing press as set forth in claim 1 wherein, said means drivingly connecting said third gear with said first plate cylinder includes a first differential harmonic drive means for rotating said first plate cylinder relative to said third gear, said first differential harmonic drive means comprising, a first input member drivingly connected with said third gear, said first input member having a predetermined number of internal gear teeth thereon, a first deformable output member drivingly connected to said first plate cylinder and having a number of external gear teeth thereon less than the predetermined number of internal gear teeth on said first input member and positioned such that said external gear teeth of said first output member are fully meshing along a portion of the periphery thereof with said internal gear teeth, the number of said internal gear teeth and said external gear teeth being such as to compensate for the reduced number of gear teeth on said first gear so that said first plate cylinder is rotated at the surface speed of said first blanket cylinder, a first wave generator member movable relative to said first output member to deform said first output member such that the portion of said external gear teeth thereon meshing with a portion of said internal gear teeth on said first input member varies to thereby vary the circumferential position of said first plate cylinder relative to said third gear, and a first motor means drivingly connected to said first wave generator member to effect rotation of said first wave generator member upon actuation thereof, said means drivingly connecting said fourth gear with second plate cylinder comprising a second differential harmonic drive means for rotating said second plate cylinder relative to said fourth gear, said second differential harmonic drive means comprising, a second input member drivingly connected with said fourth gear, said second input member having a predetermined number of internal gear teeth thereon, a second deformable output member drivingly connected to said second plate cylinder and having a number of external gear teeth thereon less than the predetermined number of internal gear teeth on said second input member are fully meshing along a portion of the periphery thereof with said internal gear teeth, the number of said internal gear teeth on said second input member and said external gear teeth on said second output member being such as to compensate for the reduced number of gear teeth on said second gear so that said second plate cylinder is rotated at the surface speed of said second blanket cylinder, a second wave generator member movable relative to said second output member to deform said second output member such that the portion of said external gear teeth thereon meshing with a portion of said internal gear teeth on said second input member varies to thereby vary the circumferential position of said plate cylinder relative to said fourth gear, a second motor means drivingly connected to said second wave generator member to effect rotation of said second wave generator member upon actuation thereof.

3. A printing press as set forth in claim 2 further including, control means for maintaining said first and second motor means in an inactive condition in which said first and second motor means are ineffective to drive said first and second wave generator members during operation of printing press to print indicia on sheet material with the indicia in a predetermined positional relationship with the sheet material and for activating at least one of said first and second motor means to drive the associated one of said wave generators to adjust the position of the indicia relative to the sheet material to the predetermined positional relationship.

4. A printing press as set forth in claim 1 wherein, the ratio of the number of teeth on said first gear to the number of teeth on said third gear is different than the ratio of the diameter of the circular outer surface of said first bearer to the circular outer surface of said fourth bearer.

5. A printing press as set forth in claim 1 wherein, the ratio of the diameter of the circular outer surface of said first bearer to the diameter of the circular outer surface of said third bearer is different than the ratio of the design pitch diameter of said first gear to the design pitch diameter of said third gear.

* * * * *